US005649364A

United States Patent [19]

Ilanlou

[11] Patent Number: 5,649,364

[45] Date of Patent: Jul. 22, 1997

[54] DISPOSABLE MULTI-BLADE STRAIGHT RAZOR

[76] Inventor: Jamshid Ilanlou, 10635 Scott Mill Rd., Jacksonville, Fla. 32223

[21] Appl. No.: 377,918

[22] Filed: Jan. 25, 1995

[51] Int. Cl.[6] ..... B26B 21/10; B26B 21/52

[52] U.S. Cl. ..... 30/40.2; 30/50; 30/528

[58] Field of Search ..... 30/53, 50, 57, 30/62, 67, 85, 88, 89, 90, 162, 156, 40.2, 40, 40.1, 528

[56] References Cited

U.S. PATENT DOCUMENTS

| | | | |
|---|---|---|---|
| 2,192,362 | 3/1940 | Merlo | 30/62 X |
| 2,370,815 | 3/1945 | Ross | 30/85 X |
| 3,488,843 | 1/1970 | Tims, Jr. | 30/162 |
| 3,728,788 | 4/1973 | Pearson | 30/53 |
| 3,768,162 | 10/1973 | Perry | 30/50 X |
| 3,879,847 | 4/1975 | Roll | 30/162 |
| 4,454,653 | 6/1984 | Chen | 30/53 |
| 4,612,705 | 9/1986 | Althaus | 30/40 X |
| 4,663,843 | 5/1987 | Savage | 30/50 X |
| 4,920,644 | 5/1990 | LaGattuta | 30/53 |

*Primary Examiner*—Rinaldi I. Rada
*Assistant Examiner*—Elizabeth Stanley

[57] ABSTRACT

A straight razor has a handle portion and a disposable multi-blade assembly with at least two blades as the cutting edge on at least one of its sides. A molded guard portion at the bottom of the blade portion prevents the blades from cutting into the skin by keeping the cutting edge limited to the surface in common among the sharp edges of the blades and the bottom guard portion. The blade assembly may be connected to the handle by a pivotable blade holder attached to the handle. The blade holder is attachable to disposable blade assemblies at one end of the blade assemblies. A tube-shaped handle may be directly attached to the blade assembly that slides over the blade to form a handle on either ends of the blade. The handle and the blade holder portions may be made of disposable materials and the blade assembly is permanently attached to the blade holder so that the entire multi-blade straight razor is disposable. The handle and the blade holder portions may be made of non-disposable materials such that only the blade assembly is disposable. The handle has a longitudinal recess which accommodates the blade holder attached to a blade by folding the blade holder toward the handle and into the recess. The handle portion may have any external shape, such as protrusions for better holding, or corrugated portions.

10 Claims, 3 Drawing Sheets

DISPOSABLE MULTI-BLADE STRAIGHT RAZOR

THE FIELD OF INVENTION

The invention relates to a straight razor with a disposable guarded multi-blade cutting edge attachable to a razor handle.

BACKGROUND OF THE INVENTION

A straight razor is a razor device comprising a handle portion having two ends where one of its ends may be pivotally attached to the blade assembly by a variety of means. The handle may have a recess for accommodating the razor blade when not in use by folding the blade holding portion towards the handle and placing it into the recess.

The straight razor is used mostly by barbers and is sharpened before use. The same blade is used for different customers which is a health hazard by transmitting bacteria and virus from one customer to the others unless the blade is completely cleaned and disinfected after each use. The disposable blades for straight razors have been in the market but all have a single blade similar to the original straight razor design that do not provide the smooth, close shave the multi-blade system can provide.

SUMMARY OF THE INVENTION

An object of the present invention is to provide a straight razor with a disposable multi-blade that is made of economical and disposable materials. Such multi-blade structure provides a close shave similar to that of a regular straight razor as well as the smooth shave of a double blade cutting edge.

According to the present invention the straight razor has a handle portion and a blade holder attached to the handle. The blade holder is attachable to disposable blade assemblies at one end of the blade assembly such that the blade assembly and the blade holder both may either pivotally or at a fixed position be attached to the handle. In one embodiment the handle and the blade holder portions are made of disposable materials and the blade assembly is permanently attached to the blade holder so that the entire multi-blade straight razor is disposable. In a second embodiment the handle and the blade holder portions are made of non-disposable materials such that only the blade assembly is disposable.

The handle and the blade holder in a fully disposable version are made of inexpensive materials such as molded plastic materials, metals and wood where metal is the preferred material for the handle and the blade holder in a partially disposable version. The blade assembly is made of conventional materials suitable for disposable multi-blade assemblies packaged in a cartridge dispenser that may be easily removed one-by-one at the time of use.

The disposable multi-blade assembly has at least two blades as the cutting edge on at least one side. A molded guard portion at the bottom of the blade portion prevents the blades from cutting into the skin by keeping the cutting edge limited to the surface in common among the sharp edges of the blades and the bottom guard portion.

The handle has a longitudinal recess along one of its edges which accommodates the blade holder attached to a blade assembly by pivotally moving the blade holder and folding the blade holder toward the handle, into the recess. The handle portion may have any external shape and pattern such as protrusions for better holding, or corrugated portions. A plurality of the blade assemblies may be stored in a blade dispenser having compartments for each blade assembly that may be removed after the blade holder is attached to one of the blade assemblies.

DETAILED DESCRIPTION OF THE PREFERRED EMBODIMENTS

Figure 1:
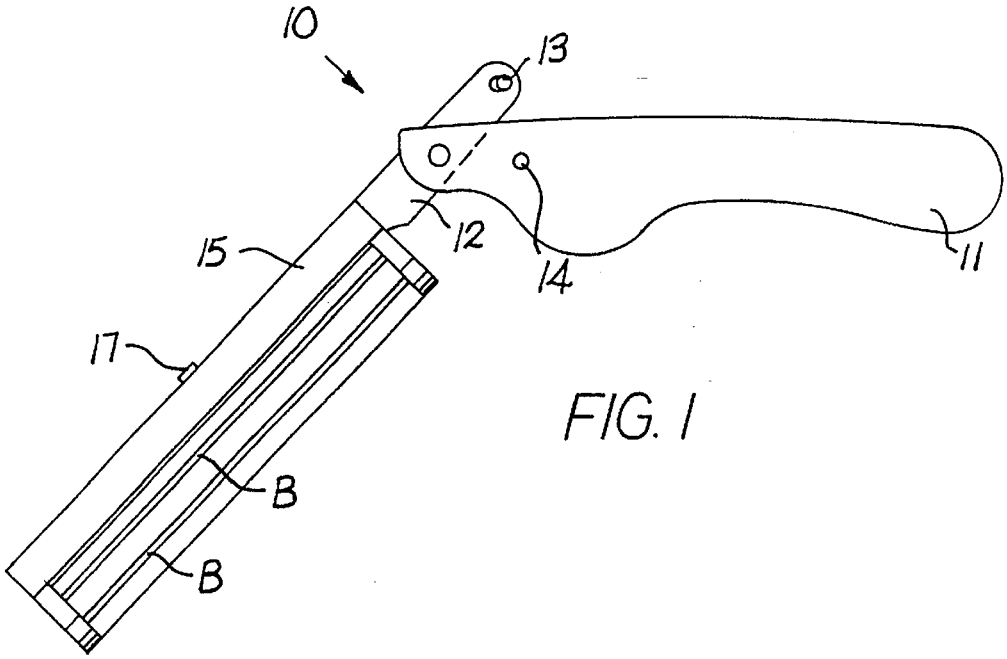
FIG. 1 is a side view of the straight multi-blade razor.
Figure 2:
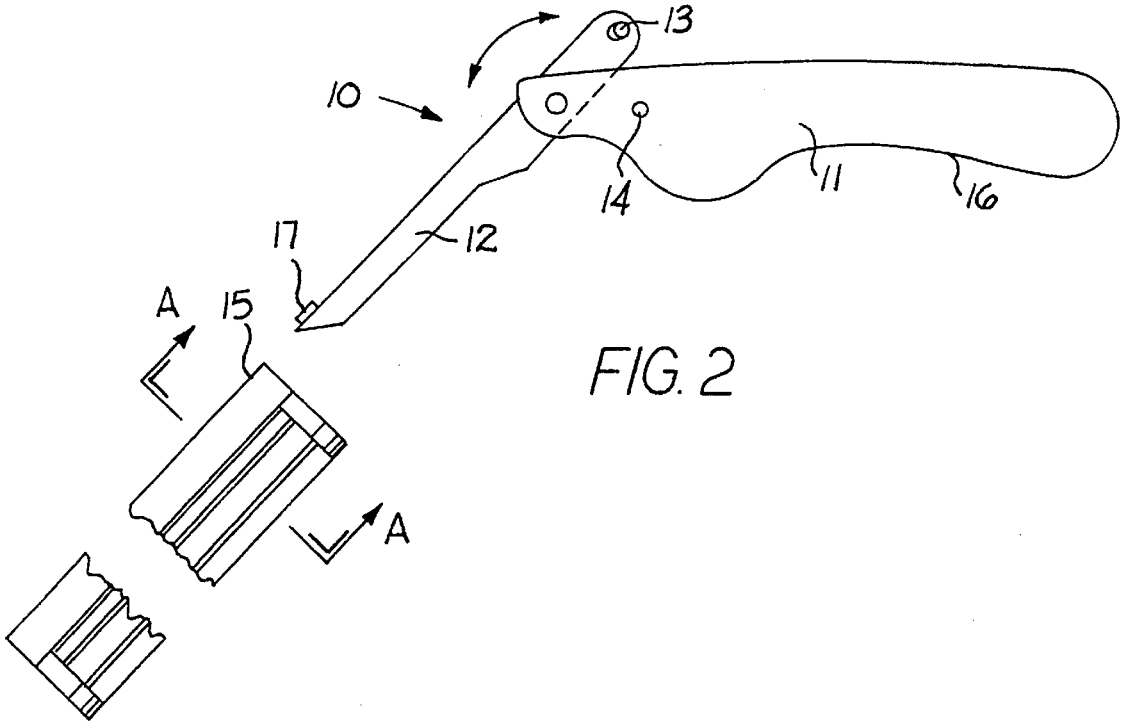
FIG. 2 is a side view of the straight multi-blade razor with the blade assembly separated from the blade holder.

The straight razor 10 as shown in FIGS. 1 and 2 has a handle portion 11, a blade holder 12 attached to one end of the handle portion and a multi-blade disposable blade assembly 15 which at one of its two ends is connected to the blade holder forming a long blade straight razor. The blade holder 12 may be connected to the handle portion 11 such that the blade holder pivotally moves to a straight position in line with the handle portion 11 during the use and folds down on to the handle portion for storage. The handle portion may have a longitudinal recess on its side 16 which can accommodate the blade holder and the blade assembly when the razor is folded. A latching means 13 may be formed on the blade holder to keep it in place when positioned in the latch opening 14 on the handle portion. By pressing the latching means and folding the blade holder simultaneously, the latching means 13 can be disengaged and the straight razor 10 is folded. Similar latching means 17 on the other end of the blade holder 12 can keep it fixed to the blade assembly 15 which may be pressed and released when the blade assembly 15 is to be removed from the blade holder 12. The handle portion 11, the blade holder 12 and the blade assembly 15 are made of materials such as metal, plastic and wood which can be easily selected for disposable or non-disposable portions and are economical to make the disposable parts. In a fully disposable version, the handle portion 11, the blade holder 12 and the blade assembly 15 are all made of disposable materials that may be disposed after use. In a partially disposable straight razor, the handle portion 11 and the blade holder 12 are made of materials that may be reused and only the blade assembly 15 is made of disposable materials that may be disposed after use.

Figure 6:
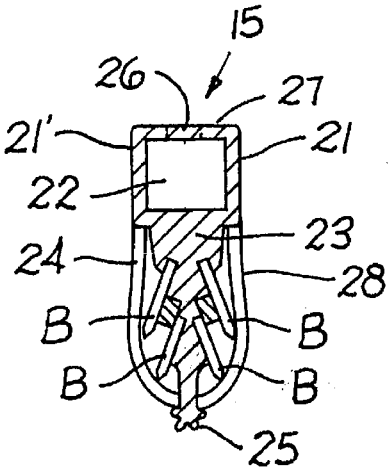
FIG. 6 is a sectional view taken along the line A—A of FIG. 2.

FIG. 6 is a cross sectional view taken along the line A—A of FIG. 2 and shows the multi-blade structure of the blade assembly 15. The blade assembly 15 has two longitudinal side surfaces 24 and 28, two side edges 21 and 21', a longitudinal top edge 27 and a longitudinal bottom edge 25. The blade assembly 15 is at least 1.5 inches long and preferably 3 inches long. On each side surface 24, 28, at least two parallel cutting blades B are placed spaced apart at an inclined angle larger than zero and smaller than 90 degrees with respect to the side surfaces with their cutting edges at a downwardly position such that the cutting edges of all the blades are in contact with the skin surface along one of the longitudinal sides while a main molded frame body 23 and the inner space between the cutting blades B is filled with molding materials such as plastic or other synthetic materials. The cutting blades B have at least one-third of their width out of the molding material to provide at least a double blade cutting surface that provides a close shave. The straight razor may be used on either side surface 24, 28 for close shaving while providing the convenience of a straight razor. A part of the molding material is extended down to the bottom edge 25 to provide a guard 29 for the blades' cutting edges such that the sharp edges of the cutting blades B may not cut into the skin. The top edge 27 and the two side edges 21, 21' enclose a hollow tube 22 whose inner cross sectional shape is the same as the outer cross sectional shape of the blade holder 12. The blade holder 12 is slid through the tube 22 and may be held in place by inserting the latching means 17 in an opening 26 which is formed in the upper edge 27. The blade assembly 15 has a cap 18 at both ends for keeping the cutting blades B in place, providing added structural support and guarding the blades from cutting into the skin.

Figure 3:
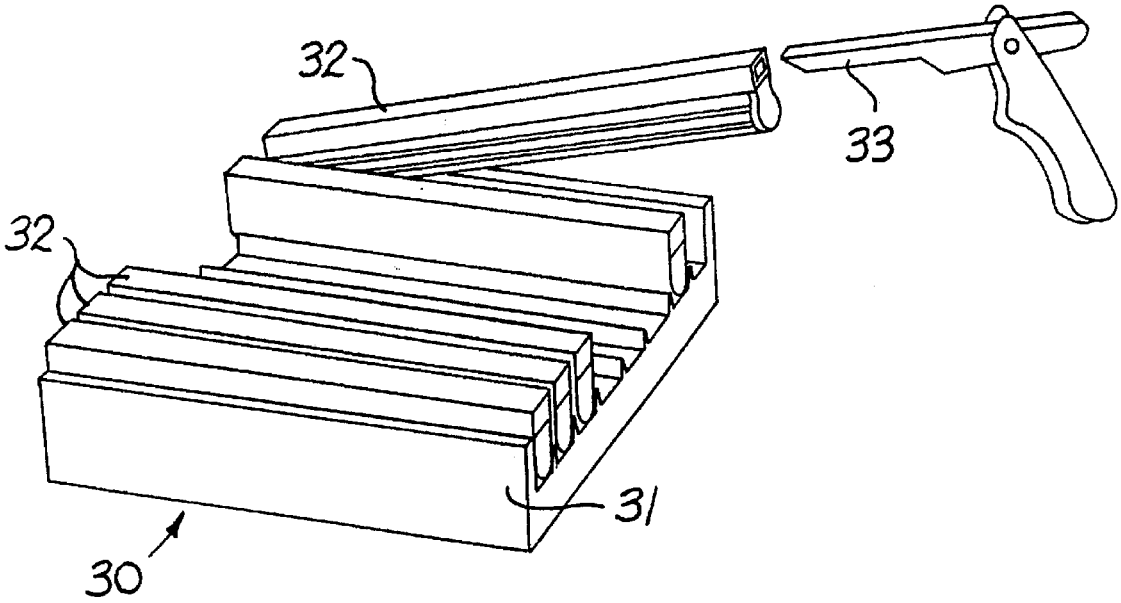
FIG. 3 is a perspective view of the blade assembly dispenser with one blade assembly being removed by connecting it to the connection means.

FIG. 3 is a perspective view of the blade assembly dispenser 30 according to another embodiment of the present invention. A plurality of blade assemblies 32 are placed in a blade dispenser 31 each in a compartment formed inside the dispenser 30. The blade assembly 32 may be removed by attaching it to the blade holder 33 and pulling the blade assembly 32 out of the compartment that holds it. Each blade assembly 32 stays in its compartment due to the tight grip the sides of the compartment have on the blade assembly which can be overcome by a slight upward force or by pulling the blade holder attached to the blade assembly upward.

Figure 4:
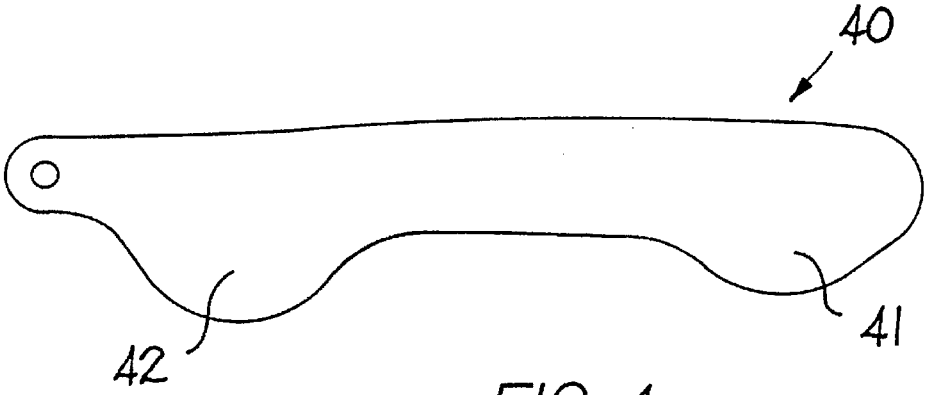
FIG. 4 is a side view of one configuration of the handle portion.
Figure 5:
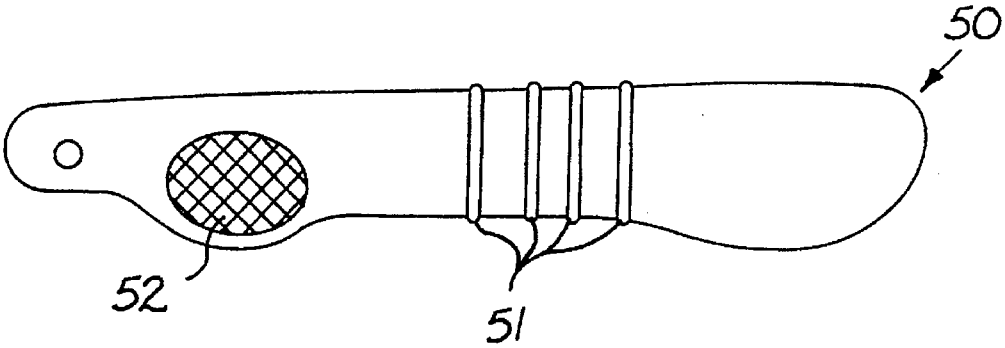
FIG. 5 is a side view of another configuration of the handle portion.

FIGS. 4 and 5 show different shapes and surface textures that the handle portions 40 and 50 may have. At least one protrusion 42, 41 on the handle portions 40, 50 provides added area for improved grip on the straight razor while shaving. The outer surface of the handle portion may also have corrugated areas 51 and 52 that prevent slipping of the straight razor during use especially when held with wet hands. The handle portions 40 and 50 may have similar shapes and outer surface textures for both the disposable and the non-disposable versions.

Figure 7:
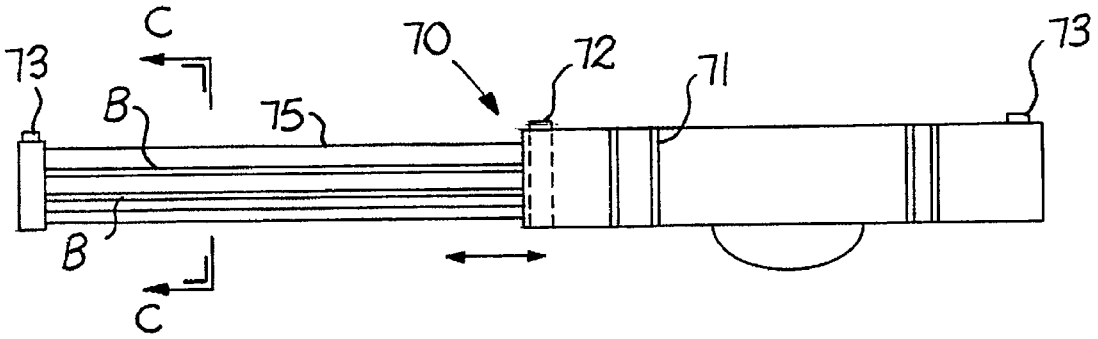
FIG. 7 and FIG. 8 are side views of another embodiment according to the present invention.
Figure 8:
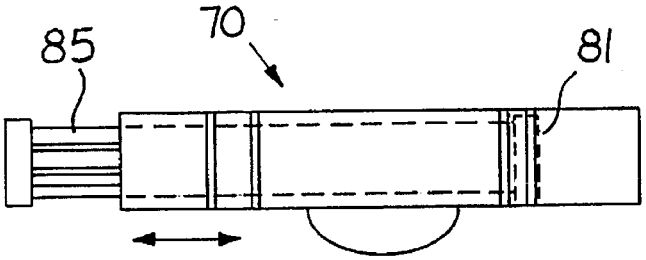
Figure 9:
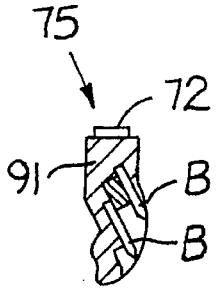
FIG. 9 is a sectional view taken along line C—C of FIG. 7.

FIGS. 7 and 8 show another embodiment according to the present invention comprising a straight razor 70 where the blade assembly 75 and 85 has at least two blades B on one side and the handle portion 71 and 81 may be slid over the blade assembly from one end to the other end so that the one-sided blade assembly 75,85 may be used for shaving both sides of the face. The handle portion 71 and 81 may also serve as the blade assembly cover for storage purposes. Latching means 72, 73 at both ends of the blade assembly 75 fit into openings on the handle portion to secure the straight razor 70 in its open position during use. By pressing on the latching means 72, the handle portion slides over the blade assembly to the other end and allows the latching means 73 to be engaged and the straight razor 70 is ready to be used on the other side of face. The cross sectional view of the blade assembly 75 with one side is shown in FIG. 9 where the latching means 72 is shown on the upper edge of the blade assembly. The blade assembly 75 has at least two parallel cutting blades B that are placed spaced apart at an inclined angle larger than zero and smaller than 90 degrees with respect to a side surface with their cutting edges at a downwardly position while a main molded frame body 91 and the inner space between the blades B is filled with molding materials such as plastic or other synthetic materials. The blades B have at least one-third of their width out of the molding material to form at least a double blade cutting surface that provides a close shave.

While particular embodiments of the invention have been shown and described, various modifications will be apparent to those skilled in the art and therefore it is not intended that the invention be limited to the disclosed embodiments or to the details thereof and departures may be made therefrom within the spirit and scope of the invention.

I claim:

1. A straight razor which is at least in part disposable comprising a handle portion having two ends, a blade holder having a first blade holder end and a second blade holder end where said first blade holder end is attached to one end of said handle portion, and a blade assembly having two blade assembly ends with one of said blade assembly ends attached to said second blade holder end, wherein the blade assembly has two longitudinal sides, a longitudinal top edge, and a longitudinal bottom edge where at least two blades having cutting edges are mounted on at least one of said two longitudinal sides onto a molded frame and held in place parallel to each other with said cutting edges of said blades facing downwardly toward said longitudinal bottom edge of said blade assembly at an inclined angle smaller than 90 degrees and larger than zero with respect to said sides of said blade assembly such that said cutting edges of all the blades contact a straight razor user's skin surface along one of said longitudinal sides for providing a close shave, wherein said blade assembly further comprises a hollow tube on said longitudinal top edge, said hollow tube having an innercross-sectional shape identical to an outer cross-sectional shape of said blade holder to allow said blade holder to slide and fit into said hollow tube, said blade assembly further includes a latching means engaging an opening in said hollow tube for preventing said blade holder from sliding out of said hollow tube on said longitudinal top edge of said blade assembly while said straight razor is being used.

2. The straight razor as recited in claim 1 wherein the blade holder folds at a pivotal connection point where said handle portion and said blade holder are attached and where said handle portion further includes a longitudinal recess on a bottom side of said handle portion along the longitudinal bottom edge of said blade assembly for accommodating said blade holder and said blade assembly when said straight razor is fully folded.

3. The straight razor as recited in claim 2 wherein said blade holder has a latching means for being latched into an opening on said handle portion when said straight razor is fully opened for preventing said straight razor from folding during use.

4. The straight razor of claim 1 where said handle portion has an outer surface covered with protrusions for improved grip.

5. The straight razor of claim 1 wherein said handle portion has a corrugated outer surface for improved grip.

6. The straight razor of claim 1 wherein said handle portion, said blade holder and said blade assembly are made of materials selected from a group comprising metals, plastics and wood.

7. The straight razor of claim 6 wherein said handle portion, said blade holder and said blade assembly are made of disposable materials that may be disposed after using said straight razor.

8. The straight razor of claim 6 wherein said handle portion and said blade holder are made of materials that may be reused and only said blade assembly is made of disposable materials that may be disposed after using said straight razor.

9. The straight razor of claim 1, wherein said blade assembly is detachable from a blade assembly dispenser made of disposable materials, said blade assembly dispenser holds several of said blade assemblies, each in a compartment formed in said dispenser ready for attachment to said blade holder and removing said attached blade assembly from said compartment on said blade assembly dispenser.

10. A straight razor which is at least in part disposable comprising a handle portion having two ends, a blade holder having a first blade holder end and a second blade holder end where said first blade holder end is attached to one end of said handle portion, a blade assembly having two blade assembly ends with one of said blade assembly ends attached to said second blade holder end, wherein said blade assembly has two longitudinal sides, a longitudinal top edge, and a longitudinal bottom edge where at least two blades having cutting edges are mounted on at least one of said two longitudinal sides onto a molded frame and held in place parallel to each other with the cutting edges of said blades facing downwardly toward the longitudinal bottom edge of said blade assembly at an inclined angle smaller than 90 degrees and larger than zero with respect to said sides of said blade assembly such that the cutting edges of all the blades contact a straight razor user's skin surface along one of the longitudinal sides for providing a close shave, wherein said blade assembly further comprises a hollow tube on said longitudinal top edge, said hollow tube having an inner cross-sectional shape identical to an outer cross-sectional shape of said blade holder so that said blade holder may slide and fit into said hollow tube.

* * * * *